US008286831B2

(12) United States Patent
Blansit et al.

(10) Patent No.: US 8,286,831 B2
(45) Date of Patent: Oct. 16, 2012

(54) DISPENSER HAVING VACUUM SWITCH CONTROLLED PUMP WITH BLEED VALVE

(75) Inventors: Jeffrey Alan Blansit, Farmington, MN (US); Henry Louis Carbone, II, St. Paul, MN (US); Aron David Dahlgren, Minneapolis, MN (US); Warren Dale Pannkuk, Lakeville, MN (US)

(73) Assignee: Ecolab USA Inc., St. Paul, MN (US)

( * ) Notice: Subject to any disclaimer, the term of this patent is extended or adjusted under 35 U.S.C. 154(b) by 508 days.

(21) Appl. No.: 12/562,286

(22) Filed: Sep. 18, 2009

(65) Prior Publication Data

US 2011/0068199 A1 Mar. 24, 2011

(51) Int. Cl.
*B67D 7/06* (2010.01)

(52) U.S. Cl. ..... 222/63; 222/133; 222/144.5

(58) Field of Classification Search ..... 222/132, 222/133, 134, 129.1, 129.2, 144.5, 52, 61, 222/63, 282; 137/892, 893; 141/105, 351
See application file for complete search history.

(56) References Cited

U.S. PATENT DOCUMENTS

| | | | | |
|---|---|---|---|---|
| 3,696,333 | A | | 10/1972 | Mott |
| 4,507,054 | A | | 3/1985 | Schoenmeyr |
| 4,795,061 | A | | 1/1989 | Peckjian |
| 4,940,164 | A | | 7/1990 | Hancock et al. |
| 5,259,557 | A | | 11/1993 | Spriggs et al. |
| 5,542,583 | A | | 8/1996 | Boyer et al. |
| 5,584,327 | A | | 12/1996 | Thomas et al. |
| 5,915,592 | A | * | 6/1999 | Mehus et al. ..... 222/1 |
| 6,059,536 | A | | 5/2000 | Stingl |

(Continued)

FOREIGN PATENT DOCUMENTS

EP 0 863 278 A2 9/1998

(Continued)

OTHER PUBLICATIONS

International Search Report dated Jul. 21, 2011 for corresponding PCT application PCT/IB2010/054225.

(Continued)

*Primary Examiner* — Kevin P Shaver
*Assistant Examiner* — Patrick M Buechner
(74) *Attorney, Agent, or Firm* — IPLM Group, P.A.

(57) ABSTRACT

A dispenser 10 creates a use solution. The dispenser 10 includes a diluent inlet for receiving a source of diluent. A first aspirator 38 is in fluid communication with the diluent inlet. An operator valve 27 controls flow of the diluent. A second aspirator 46 has a diluent inlet, diluent outlet and a venturi port. A vacuum switch 63 is operatively connected to the first venturi port and the flow of the diluent through the aspirator 46 creates a vacuum that activates the vacuum switch. A control board 69 is activated by the vacuum switch and a dosing pump 76 is activated by the control device 69. The dosing pump dispenses a liquid product into the diluent stream, wherein a use solution is made.

19 Claims, 10 Drawing Sheets

U.S. PATENT DOCUMENTS

| | | | | |
|---|---|---|---|---|
| 6,147,599 | A * | 11/2000 | Jones | 340/467 |
| 6,158,673 | A | 12/2000 | Toetschinger et al. | |
| 6,257,000 | B1 * | 7/2001 | Wang | 222/3 |
| 6,871,674 | B2 | 3/2005 | Thomas et al. | |
| 7,331,488 | B2 * | 2/2008 | Naslund et al. | 222/144 |
| 2004/0255988 | A1 * | 12/2004 | DuHack et al. | 134/57 D |
| 2005/0072800 | A1 | 4/2005 | Smith | |
| 2006/0243743 | A1 | 11/2006 | Mehus et al. | |
| 2006/0280292 | A1 * | 12/2006 | McCarthy | 378/200 |
| 2007/0018010 | A1 * | 1/2007 | Mehus et al. | 239/6 |
| 2007/0034644 | A1 * | 2/2007 | Bertucci et al. | 222/144.5 |
| 2007/0228075 | A1 * | 10/2007 | Edwards et al. | 222/129.1 |
| 2008/0010983 | A1 | 1/2008 | Morgan et al. | |

FOREIGN PATENT DOCUMENTS

| | | | |
|---|---|---|---|
| EP | 1 920 697 | A1 | 5/2008 |
| GB | 1431557 | | 4/1976 |
| GB | 2016088 | A * | 9/1979 |

OTHER PUBLICATIONS

"Installation & Operation Manual—Model CT-450", Ecolab Inc., 7 pages (© Ecolab Inc. 2004).

"QC Ultra Concentrate Dispensing System—Installation and Operation Manual", Ecolab Inc., 22 pages (© Ecolab Inc. 2006).

* cited by examiner

DISPENSER HAVING VACUUM SWITCH CONTROLLED PUMP WITH BLEED VALVE

BACKGROUND OF THE INVENTION

1. Field of the Invention

This invention relates generally to a dispenser and more particularly to a dispenser utilizing a vacuum switch and dosing pump combination to create a use solution with a more controlled dilution rate.

2. Description of the Prior Art

It is well known to create a use solution by diluting a chemical with a diluent, such as water. One typical way of doing so is to use an aspirator. The vacuum created by the aspirator will pull the product to be dispensed into the flow of the diluent stream and create a use solution. This is often sufficient with respect to many applications where the precise concentration of the use solution is not critical.

However, dispensing accuracy is quite critical in a number of situations, such as disinfecting areas, such as hospital rooms. If the disinfectant is not at a correct use concentration, it does not matter if the surfaces are cleaned, as an incorrect dilution may render the disinfectant ineffective. The present invention addresses the problems associated with the prior art and provides for a dispenser that accurately dispenses a correct use concentration as well as capabilities of dispensing multiple dilution rates for a liquid product. In addition, the dispenser is also able to dispense multiple products.

SUMMARY OF THE INVENTION

In one embodiment of the invention, a dispenser for dispensing a use solution is provided. The dispenser includes a diluent inlet for receiving a source of diluent. An aspirator is in fluid communication with the diluent inlet. An operator valve, for control of the diluent's flow, is moveable between an off position and an on position. The aspirator has a diluent inlet, a diluent outlet and a venturi port. A vacuum switch is operatively connected to the venturi port, wherein flow of diluent through the aspirator creates a vacuum and activates the vacuum switch. A control device is activated by the vacuum switch. A dosing pump has an inlet for receiving a source of liquid product and an outlet in fluid communication with the diluent, wherein a use solution is made; and the dosing pump is activated by the control device.

In another embodiment, the invention is a dispenser for dispensing a use solution. The dispenser includes a water inlet for receiving a source of water. An aspirator is in fluid communication with the water inlet. An operator valve, for control of the water's flow, is moveable between an off position and an on position. The aspirator has a water inlet, a water outlet and a venturi port. A vacuum switch is operatively connected to the venturi port, wherein flow of water through the aspirator creates a vacuum and activates the vacuum switch. A control device is activated by the vacuum switch. A manifold block has a first manifold inlet operatively connected to the venturi port and a manifold outlet operatively connected to the vacuum switch. A second manifold inlet is operatively connected to the manifold outlet. A vacuum bleed device is positioned in the second manifold inlet. The second manifold inlet is open to atmosphere. A constant rate dosing pump having an inlet for receiving a source of liquid product and an outlet in fluid communication with the water, wherein a use solution is made. The constant rate dosing pump is activated by the control device.

In another embodiment, the invention is a dispenser for dispensing multiple use solutions. The dispenser includes a diluent inlet for receiving a source of diluent. An aspirator is in fluid communication with the diluent inlet. An operator valve, for control of the diluent's flow, is moveable between an off position and an on position. The aspirator has a diluent inlet, a diluent outlet and a venturi port. A selector valve has an inlet, operatively connected to the venturi port, and a first outlet and a second outlet. The selector valve connects either the first selector valve outlet or the second selector valve outlet to the selector valve inlet. A first vacuum switch is operatively connected to the first selector valve outlet and a second vacuum switch is operatively connected to the second selector valve outlet, wherein flow of diluent through the aspirator creates a vacuum to selectively activate the first and second vacuum switches. A control device is activated by the first vacuum switch. The control device is also activated by the second vacuum switch. A dosing pump is selectively activated by control device.

DETAILED DESCRIPTION OF AN EMBODIMENT

Figure 1:
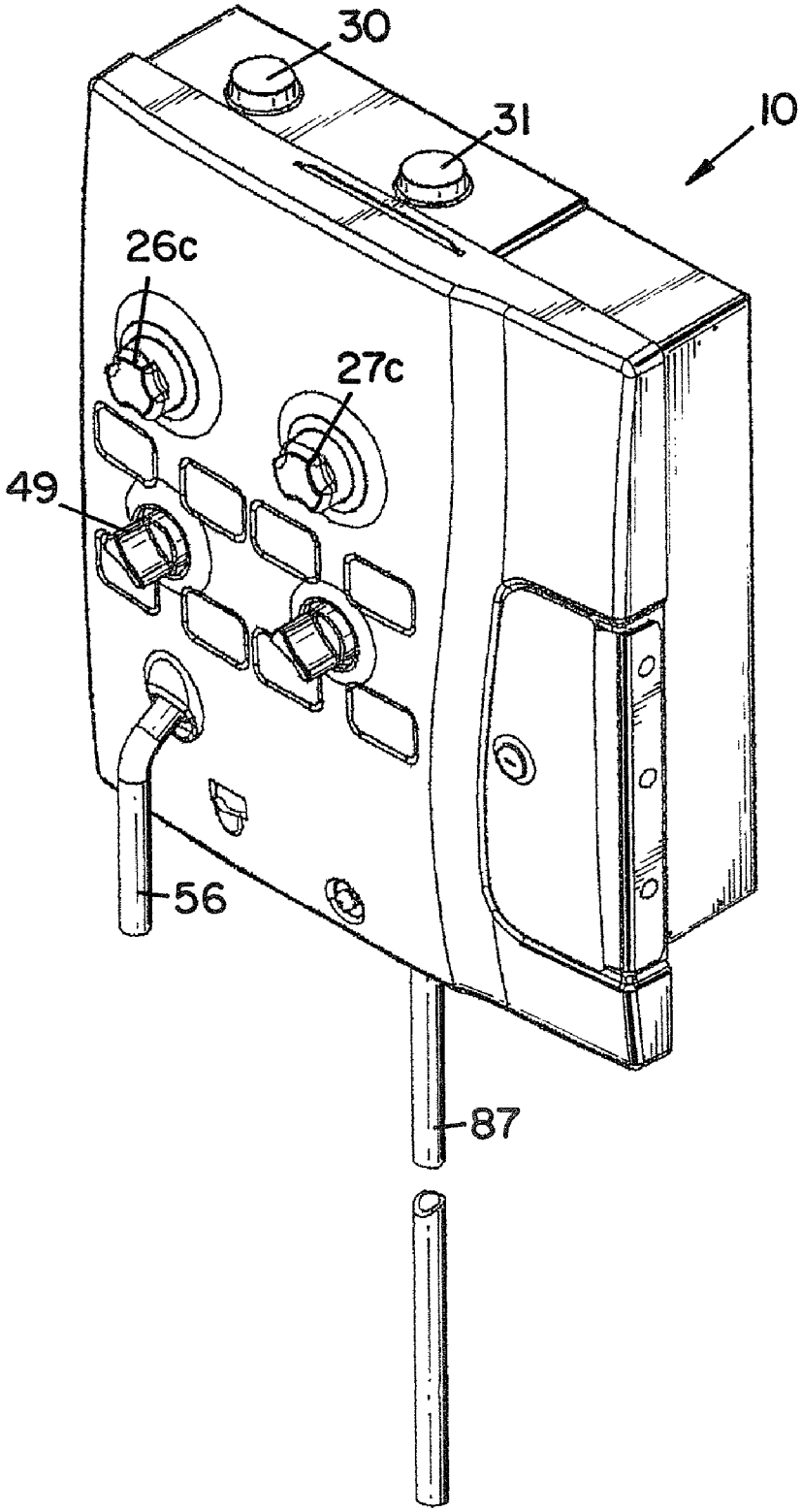
FIG. 1 is a perspective view of the dispenser according to the principles of the present invention.
Figure 2:
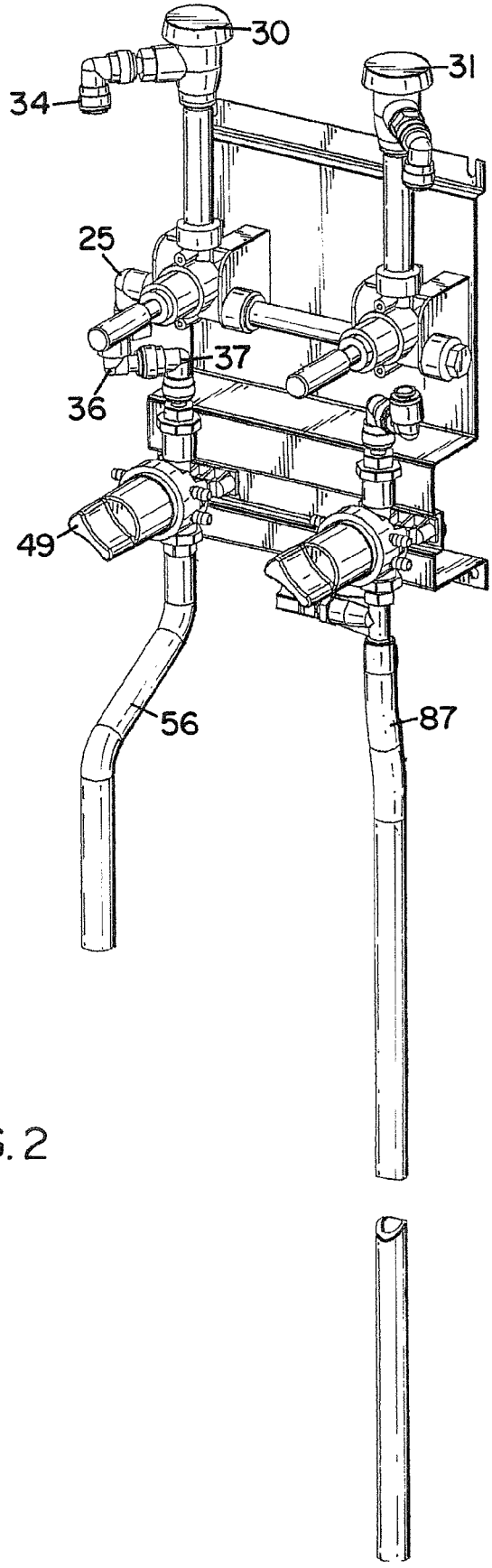
FIG. 2 is a perspective view of a portion of the dispenser shown in FIG. 1, with the front cover removed.
Figure 3:
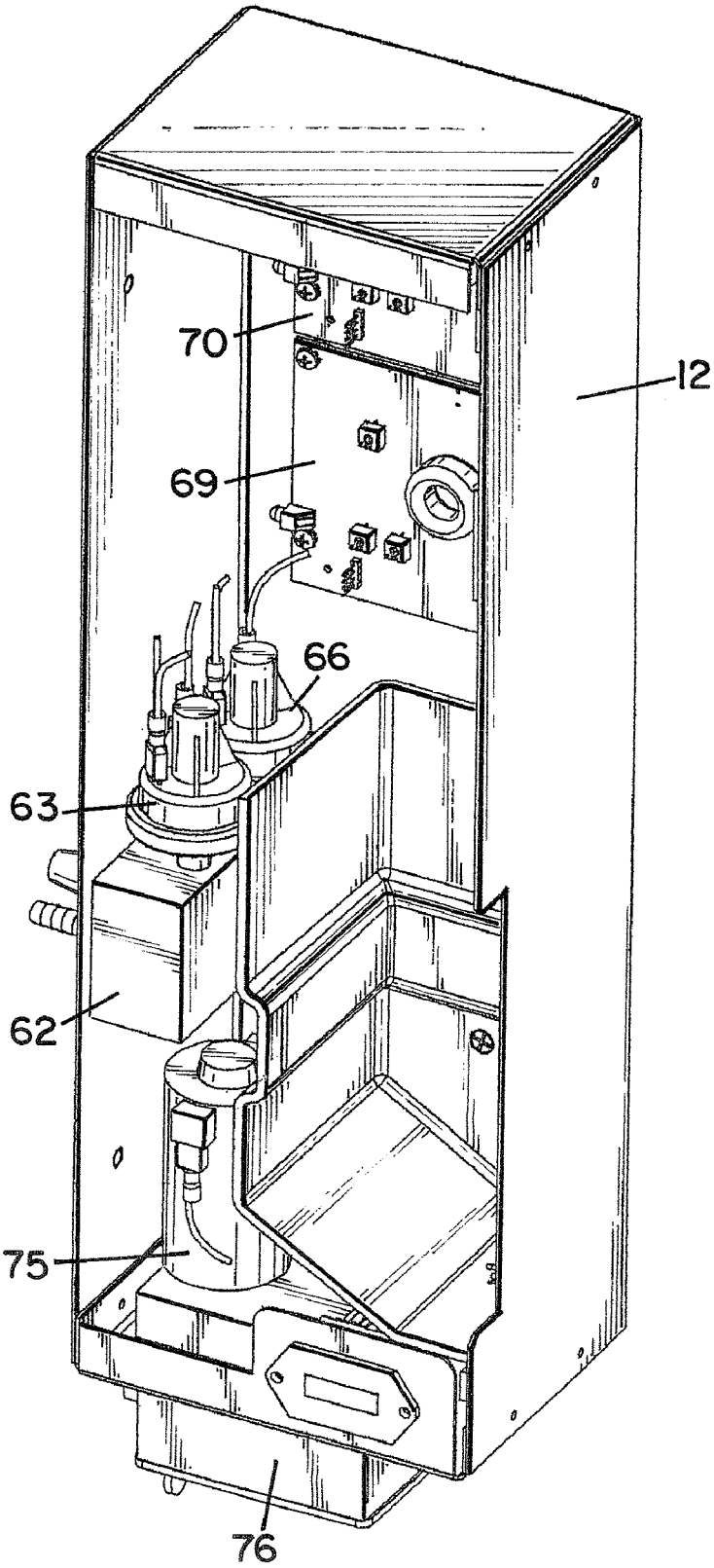
FIG. 3 is a perspective view of a portion of the dispenser shown in FIG. 1, with the front cover removed.

Referring to the drawings, wherein like numerals represent like parts throughout the general views, there is generally shown at 10 a dispenser. The dispenser 10 includes a first housing 11 and a second housing 12 operatively connected by suitable means such as nut 89, washer 90 and washer 91 onto a threaded stud on housing 12. A front cover 13 is positioned over the housings 11 and 12 and secured by suitable means. The front cover 13 has an access plate 14 that is positioned in opening 13*a*.

Figure 4:
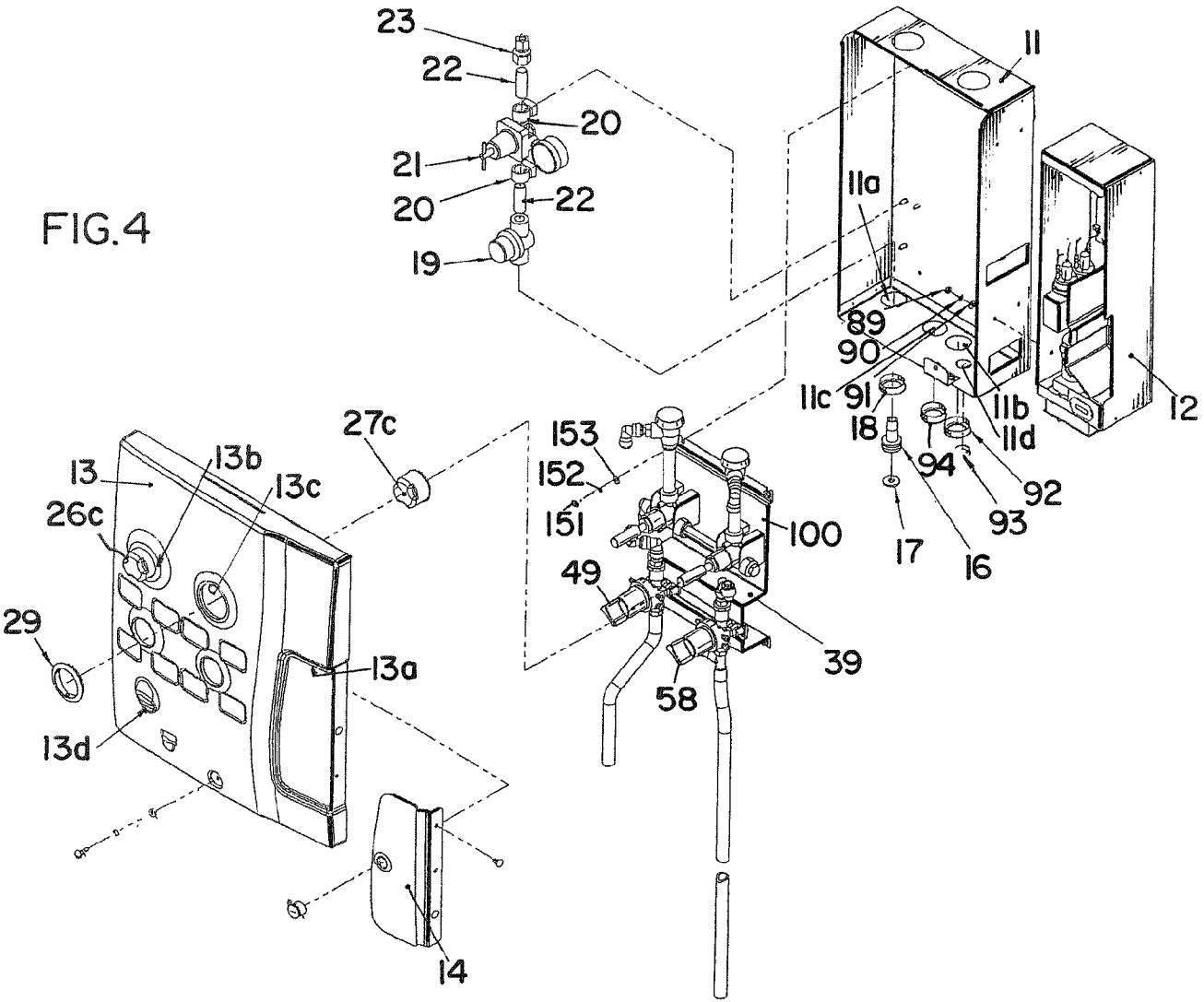
FIG. 4 is an exploded perspective view of the dispenser shown in FIG. 1.
Figure 5:
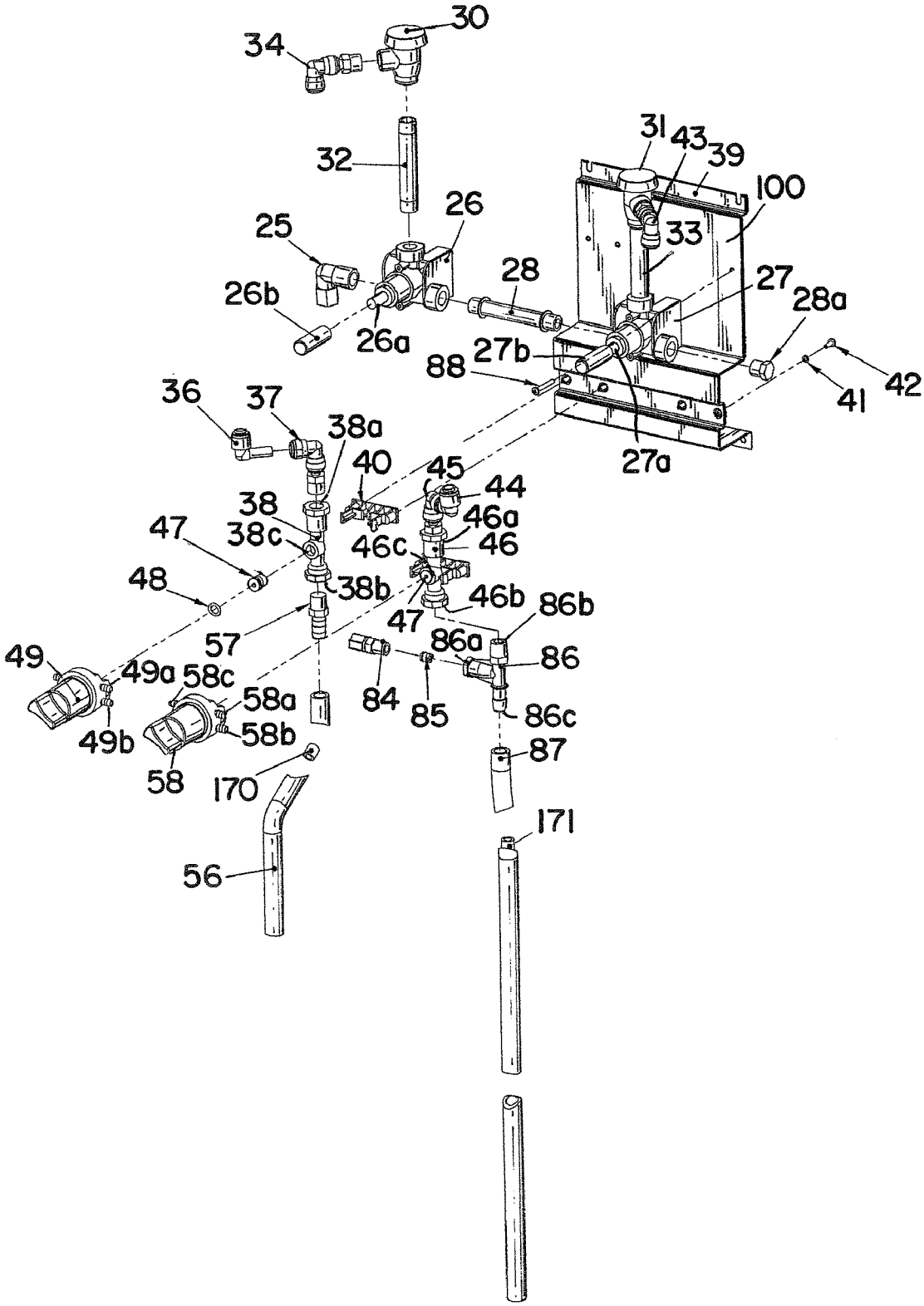
FIG. 5 is an exploded perspective view of the portion of the dispenser shown in FIG. 2.
Figure 6:
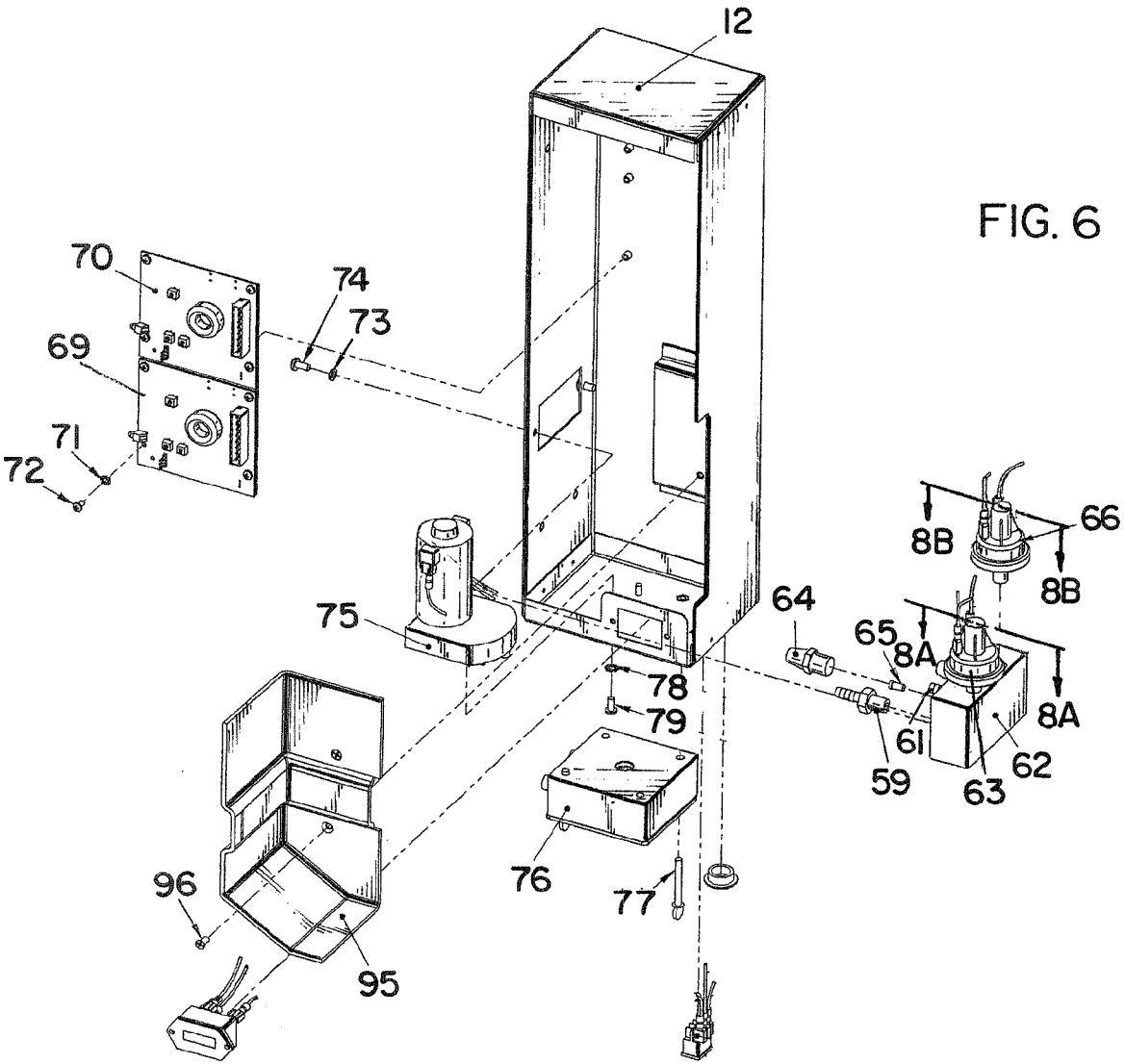
FIG. 6 is an exploded perspective view of the portion of the dispenser shown in FIG. 3.
Figure 7:
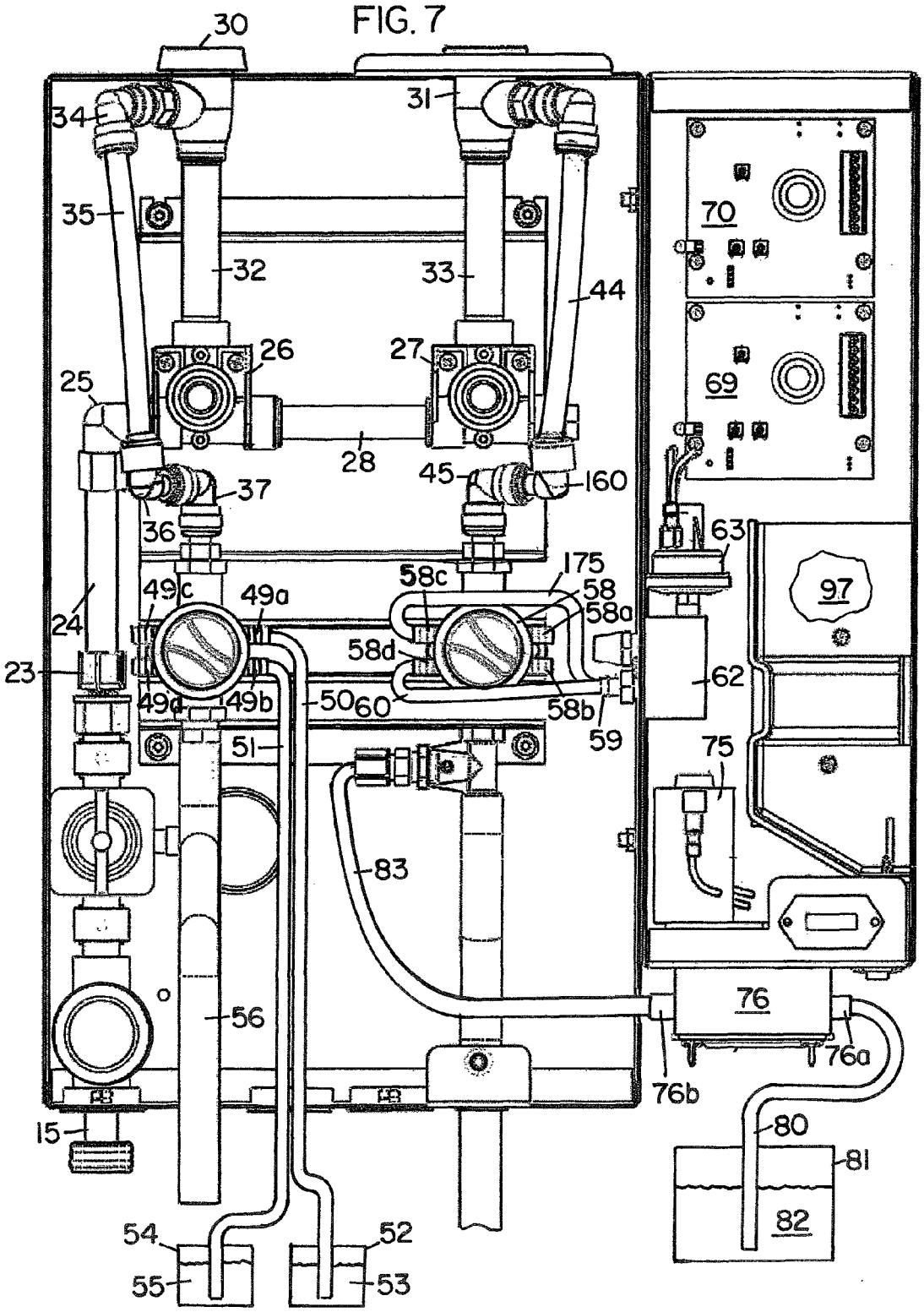
FIG. 7 is a front elevational view of the dispenser shown in FIG. 1, with the front cover removed.

Referring to FIGS. 4 and 7, an inlet conduit 15 is operatively connected to a fitting 16 with a washer 17 positioned in the fitting 16. The inlet conduit is adapted to receive water as a diluent. A bushing 18 is positioned in the opening 11*a* through which the fitting 16 is positioned. Operatively connected to, and in fluid communication with the inlet conduit 15 is a filter 19. Clips 20 are used to fasten a pressure regulator 21 to the housing 11. A fitting nipple 22 is positioned between the filter 19 and the pressure regulator 21. Another fitting or nipple 22 is positioned between the pressure regulator 21 and fitting 23. The fitting 23 has operatively connected thereto a tubing 24. It should be noted that the tubing used in the dispenser to connect various components is only shown in FIG. 7. It is not shown in the other views, except for the discharge tubing, for clarity purposes. The tubing 24 is connected via elbow 25 to operator valve 26 which in turn is in fluid communication with operator valve 27 via nipple 28. The operator valve 27 is closed by a plug 28*a*. Each operator valve 26, 27 has a push button 26*a*, 27*a* that will move the operator valves 26, 27 from an off position to an on position. Extension members 26*b*, 27*b* are positioned over the push buttons 26*a*, 27*a*. Buttons 26*c*, 27*c* are fitted over the extensions 26*b*, 27*b* and extend through and are secured in the openings 13*b* and 13*c* in the cover 13 with a bushing 29.

Vacuum breakers 30, 31 are connected to the operating valves 26, 27 by fittings 32, 33 respectively. Plumbing codes in many jurisdictions require a vacuum break, such as vacuum breakers 30, 31 to ensure that water downstream of the vacuum breakers does not flow backward into the water line in the event of loss of water pressure in the water supply line, possibly contaminating the water source supplying water. The vacuum breaks 30, 31 can be of any number of conventional water breaks, well known in the art. Elbow fitting 34 is connected to the vacuum break 30 at one end and a tube 35 at its other end. The tube 35 is also connected to another elbow 36 which is in turn connected to elbow 37. A first aspirator 38 is connected to the elbow 37. The aspirator 38 has an inlet 38*a* and an outlet 38*b*. The aspirator 38 also has a venturi port 38*c*. The aspirator 38 is well known in the art and may be any suitable aspirator. The aspirator 38 is held in position on weldment 39 by clip 40. The clip 40 is secured to the weldment 39 by suitable means such as washer 41 and screw 42. The weldment 39 is secured to the housing 11 by suitable means such as nut 151, washer 152, washer 153 onto a threaded stud on housing 11. An elbow 43 is connected to the vacuum breaker 31 at one end and a tube 44 at its other end. The tube 44 is also connected to elbow 160 which is in turn connected to elbow 45. The elbow 45 is connected to a second aspirator 46. The aspirator 46 has an opening 46*a* to which the elbow 45 is connected. The opening 46*a* is an inlet to the aspirator 46. The aspirator also has an outlet 46*b* and a venturi port 46*c*. The aspirator 46 is connected to the weldment 39 by suitable means such as washer 41 and screw 42. A nipple 47 is positioned in each of the venturi ports 38*c* and 46*c* along with a seal 48.

A first selector valve 49 is a valve that has four inputs 49*a* through 49*d*. The selector valve 49 is rotatable so that any of the four inputs are in fluid communication with the venturi port 38*c* through the outlet of the valve 49. Such a valve is well known in the art. The nipple 47 enables the selector valve 49 to be connected to the venturi port of the aspirator 38. In FIG. 7, only two tubes 50 and 51 are shown operatively connected to the inputs 49*a* and 49*b* respectively. It being understood that the other inputs 49*c* and 49*d* could also be connected to products so the aspirator 38 could dispense four different products. The tube 50 is operatively connected at one end to the input 49*a* and at its other end is positioned in a container 52 holding the liquid chemical 53 to be dispensed. Likewise, the tube 51 is connected at one end to the input 49*b* and at its other end is positioned in container 54 holding a second chemical 55. Tubes 50 and 51 may use a check valve, as is well known in the art. As will be described more fully hereafter, the operation of this portion of the dispenser 10 is similar to a typical aspirator and the chemical supplied through the aspirator 38 is dispensed as a use solution with the diluent water out the discharge tube 56 that is in fluid communication with the aspirator 38 through fitting 57, which is in fluid communication with the aspirator outlet 38*b*. Flood ring 170 restricts water flow such that sufficient back pressure is generated on the aspirator to create a vacuum.

Figure 8A:
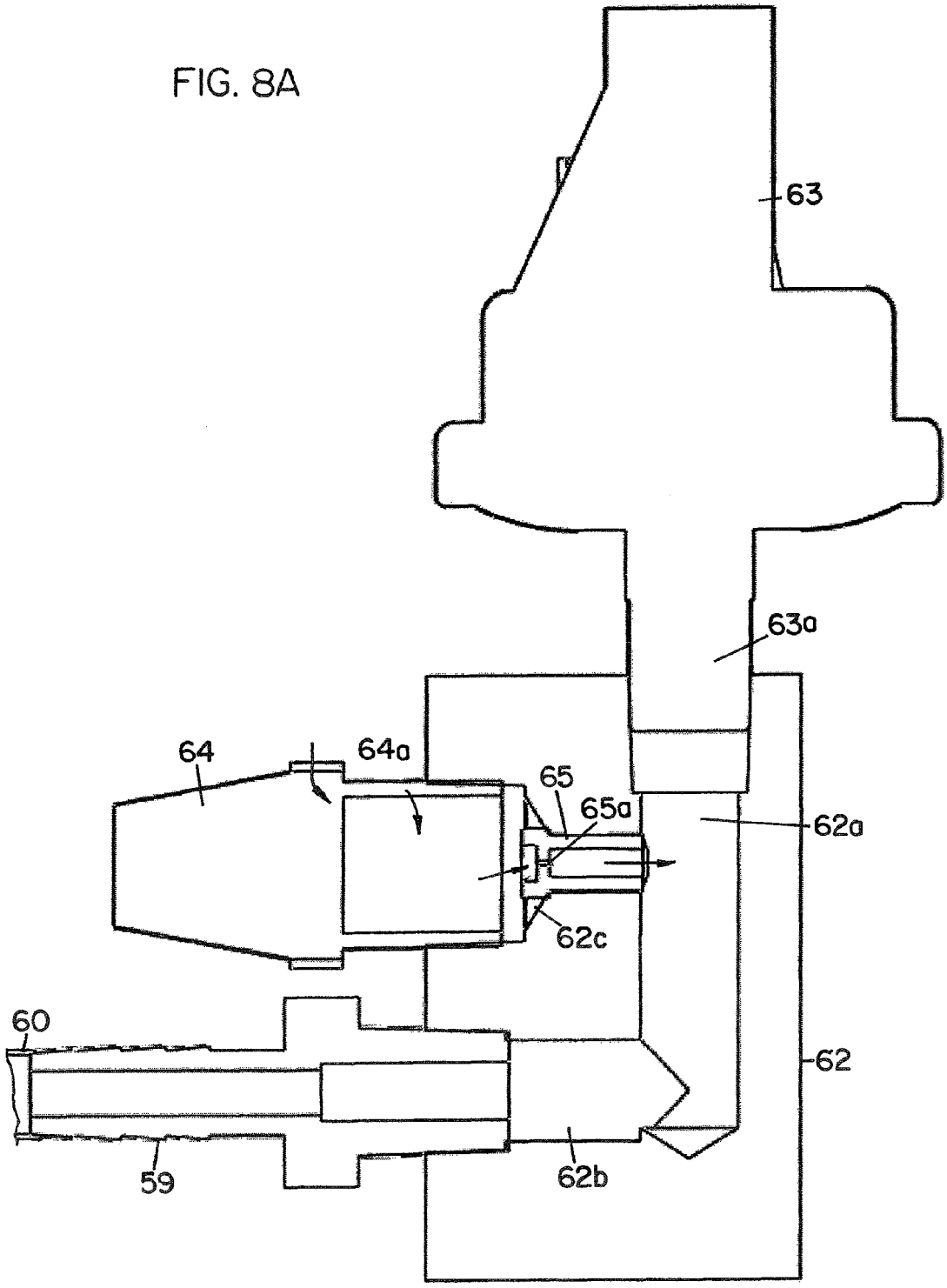
FIG. 8*a* is a cross-sectional view taken generally along the lines 8*a*-8*a* in FIG. 6.
Figure 8B:
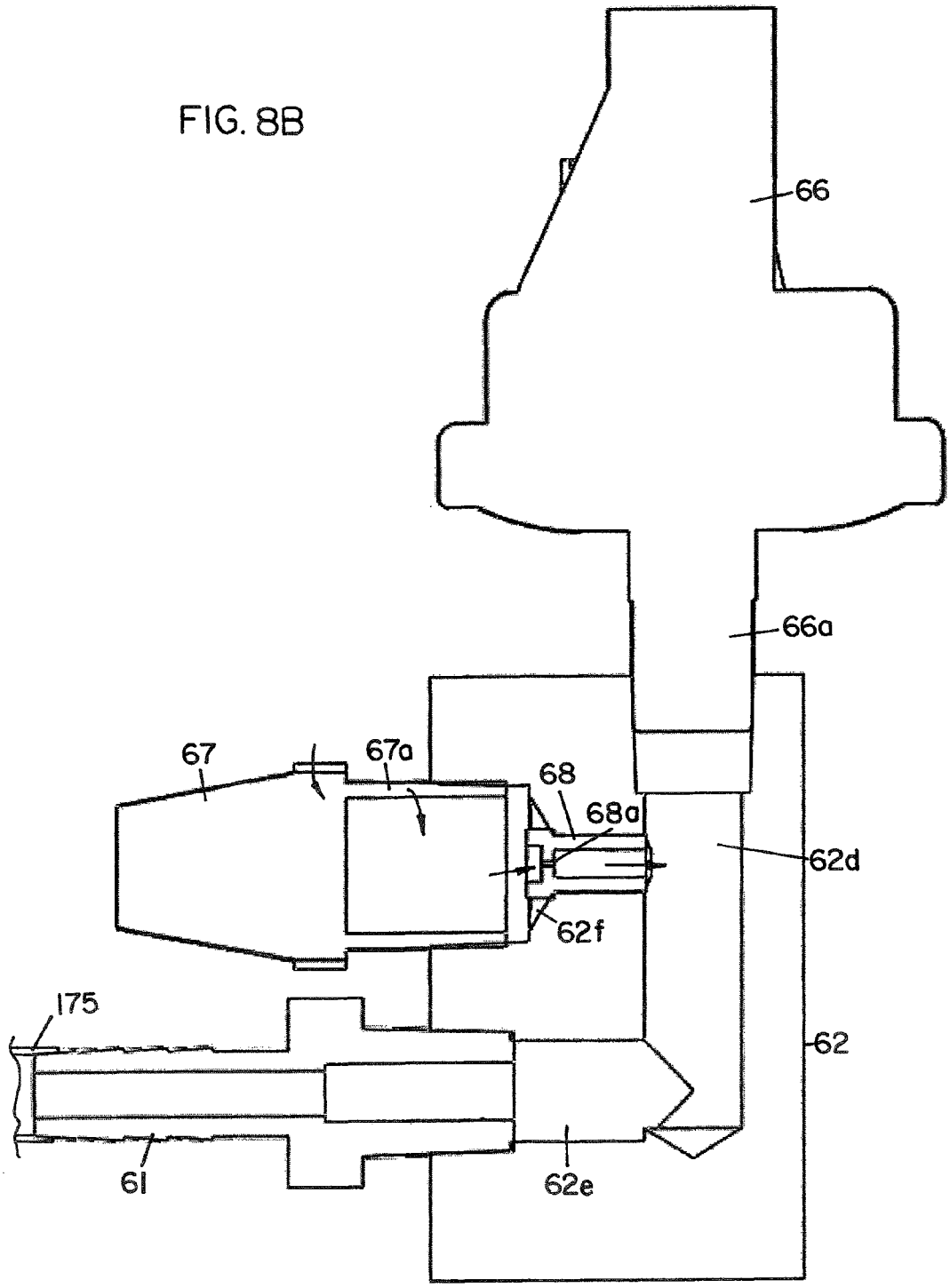
FIG. 8*b* is a cross-sectional view taken generally along the lines 8*b*-8*b* in FIG. 6.

Second selector valve 58 has four inputs 58*a* through 58*d*. Similar to inputs 49*a* through 49*d*, the inputs are ribbed for the acceptance of tubing. In the embodiment shown in the drawings, inputs 58*a* and 58*b* are not utilized. However, it is recognized that additional chemicals could be connected to inputs 58*a* and 58*b*, similar to chemicals 53 and 55 and the chemicals would be aspirated through the venturi. This is similar to inputs 49*c* and 49*d* not being utilized, but it is understood that additional chemicals could be dispensed through those inputs also. As will be described more fully hereafter, the input 58*d* is utilized for a first concentration of a use solution and input 58*c* is utilized for a second concentration of a use solution. In the embodiment shown, the first concentration of the use solution is lower than the second concentration of the use solution. Input 58*d* is operatively connected to fitting 59 by tubing 60. Similarly, input 58*c*, utilized for high concentrations, is operatively connected to fitting 61 by tubing 175. The connection to fitting 61 is not seen in FIG. 7, as fitting 61 is underneath fitting 59. However, in the cross-sectional view shown in FIG. 8*b*, the connection to fitting 61 is shown. Again, as will be described more fully hereafter, the inputs 58*c* and 58*d* are utilized differently than the other inputs 49*a* through 49*d* and 58*a* and 58*b*. Chemical product is not aspirated through inputs 58*c* and 58*d*. Instead, a vacuum created by the diluent flowing through the venturi of aspirator 46 is transferred through the venturi port 46*c* through either tubings 60 or 175, depending upon the position of the selector valve 58, to fittings 59 or 61. This vacuum is then utilized to activate a dosing pump, as will now be more fully described.

A manifold block 62 has a first vacuum switch 63 operatively connected thereto. The vacuum switch 63 has an inlet 63*a* that is inserted into passageway 62*a* (an outlet) of manifold block 62. The fitting 59 is likewise inserted into an opening in the manifold block 62 into a passageway 62*b* (a first inlet). The passageway 62*b* and 62*a* are in fluid communication with each other such that the vacuum created by the second aspirator 46 is transmitted to the vacuum switch 63. A filter 64 is connected, through an opening in manifold block 62 to a passageway 62*c* (a second inlet). The passageway 62*c* is likewise in fluid communication with the passageway 62*a*. The filter 64 may be of any suitable construction. The function of the filter 64 is to allow air to enter from the atmosphere into the filter through a suitable filtering member 64*a* into the passageway 62*c*. This path is indicated by arrows in FIG. 8*a*. Inside of passageway 62*c* is positioned a precision orifice 65. The precision orifice 65 has a sized orifice 65*a* through which the atmosphere air passes. The orifice 65*a*, positioned in the passageway 62*c*, controls the amount of air that flows from the atmosphere to the vacuum switch 63. The precision orifice 65 acts as a bleed valve device, as will be described more fully hereafter. The filter 64 substantially prevents particulate matter from blocking the precision orifice.

A manifold block 62 has a second vacuum switch 66 operatively connected thereto. The vacuum switch 66 has an inlet 66*a* that is inserted into passageway 62*d* (an outlet) of manifold block 62. The fitting 61 is likewise inserted into an opening in the manifold block 62 into a passageway 62*e* (a first inlet). The passageway 62*e* and 62*d* are in fluid communication with each other such that the vacuum created by the second aspirator 46 is transmitted to the vacuum switch 66. A filter 67 is connected, through an opening in manifold block 62 to a passageway 62*f*. The passageway 62*f* is likewise in fluid communication with the passageway 62*c*. The filter 67 may be of any suitable construction. The function of the filter 67 is to allow air to enter from the atmosphere into the filter through a suitable filtering member 67*a* into the passageway 62*f* (a second inlet). This path is indicated by arrows in FIG. 8*b*. Inside of passageway 62*f* is positioned a precision orifice 68. The precision orifice 68 has a sized orifice 68*a* through which the atmosphere air passes. The orifice 68*a* controls the amount of air that flows from the atmosphere to the vacuum switch 66. The precision orifice 68, positioned in the passageway 62*f*, acts as a bleed valve device, as will be described more fully hereafter. The filter 67 substantially prevents particulate matter from blocking the precision orifice.

Control boards 69 and 70 are electrically connected to vacuum switches 63 and 66 respectively. The vacuum switches 63 and 66 activate the control boards 69 and 70 respectively when the vacuum switches 63 or 66 have been activated by the vacuum supplied by the aspirator 46. The control boards 69 and 70 are DC analog voltage control boards. The control boards 69 and 70 provide a constant voltage output. However, each of the control boards 69 and 70 are able to be manually adjusted so that different voltages may be provided. Each board has a manually adjustable potentiometer which is used to vary the voltage output. In the present instance, control board 69 is set for a lower dilution rate than control board 70. Therefore, control board 70 is set to produce a higher constant voltage than control board 69. The control boards 69 and 70 are mounted to the housing 12 by suitable means such as washers 71 and bolts 72. The manifold block 62 is secured to the housing 12 by two sets of washers 73 and bolts 74. The control boards 69 and 70 are both electrically connected to a motor 75, so that when the control boards 69 and 70 are activated by switches 63 or 66, the motor 75 is energized. The motor 75 drives the constant rate peristaltic pump 76. The pump 76 is fastened to the underside of the housing 12 by suitable means such as screws 77. The motor 75 is fastened to the housing 12 by suitable means such as washers 78 and bolts 79. The pump 76 has an inlet 76*a* that has a tube or conduit 80 operatively connected thereto. The tube 80 extends into a container 81 in which a liquid chemical 82 is held. The pump 76 has an outlet 76*b* that is operatively connected by tubing 83. At its other end, the tubing 83 is connected to a connector 84. A check valve 85 is inserted in pipe 86. Connector 84 is in turn connected to a manifold pipe 86. The manifold pipe 86 has a first inlet 86*a* into which the connector 84 is secured. A second inlet 86*b* is operatively connected to the outlet 46*b* of the second aspirator 46. The manifold pipe 86 has an outlet 86*c* that is in fluid communication with the discharge tube 87. Flood ring 171 is positioned in discharge tube 87 and restricts water flow, similar to flood ring 170.

A battery holder 95 is secured in the housing 12 by suitable means such as bolts 96. Inside of the battery holder 95 is a battery pack 97. The battery pack 97 will typically consist of a plurality of batteries.

While the control boards 69 and 70 have been described as a DC analog voltage control board, it is understood that the boards could be digital as well. Further, while they have been described as separate boards, it is understood that the functions to control the different voltage outlets could be on the same board instead of two separate boards. Therefore a control device may be either analog or digital and could be a single board or multiple boards.

The discharge tube 56 extends through an opening 13*d* in the cover 13. The discharge tube 87 extends through opening 11*d* and through bushing 93. Another bushing 94 is provided in opening 11*c* and is available for access for tubings 50 and 51 to be connected to the selector valve 49. Opening 11*b* is available for other tubings to be connected to the selector valves 49 and 58.

In operation, the inlet conduit 15 is coupled to a source of supply water. The water is preferably maintained at a relatively constant pressure, although it is understood that the water pressure from a municipal water supply may vary. The pressure regulator 21 is used to regulate the pressure, as is well known in the art. The user has to choose which chemical to use or wishes to dispense. Assuming the user wishes to dispense the liquid chemical 53 in container 52, the selector switch 49 is turned such that the inlet 49*a* is in fluid communication with the venturi port 38*c*. Then, the operator valve 26 is moved to the on position and the diluent or water flows through the pressure regulator, through the vacuum break 30 and to the aspirator 38. As the water passes through the aspirator 38, a vacuum is created and the liquid product 53 is aspirated into the venturi port 38*c* of the aspirator 38. The chemical 53 then mixes with the water and it forms a use solution which is dispensed through the discharge tube 56. The concentration of the use solution is controlled by having an appropriate metering tip in the selector valve inlets. Once the container in which the discharge tube 56 is placed is full (typically visually monitored by the user), the user releases the operator valve 26 and the water flow ceases. Any remaining water in the line flows into the container as the vacuum breaker 30 allows air to enter the line between the vacuum breaker and the discharge tube 56 outlet. The user then removes the container from the discharge tube 56 and proceeds with the cleaning task. The operating of the dispenser, thus described, is typical of what is known in the prior art. While the concentrations are usually adequately controlled, there are instances where finer control is needed.

It is for such situations that the present invention is especially advantageous. This is seen in the dispensing of liquid chemical 82 through the second aspirator 46. The chemical 82 is typically a disinfectant or cleaner, but may be any suitable liquid chemical that is diluted with a diluent. If the chemical 82 is desired to be dispensed, the user first determines whether or not the user wants a high concentration use solution_or a low concentration use solution. The low concentration and high concentration values have been preset on the control boards, as previously discussed. Assuming the user wishes for a low concentration use solution, the selector valve 58 is turned so that the inlet port 58*d* is in fluid communication with the venturi port 46*c*. Then, the operator valve 27 is moved from the off position to the on position. This allows water to flow through the pressure regulator, through nipple 28, through the vacuum breaker 31 and then through the aspirator 46. As the water passes through the aspirator 46, a vacuum is created. This vacuum is transferred through the tubing 60 through passageway 62*b* to passage 62*a* and then through the inlet 63*a* of the vacuum switch 63. This turns the vacuum switch 63 on. The vacuum switch, in the on position, turns on electrical power to the DC speed control board 69. The DC speed control board 69 then provides a voltage output to the motor 75 which drives the dosing pump 76. The dosing pump then delivers liquid chemical 82 at a rate proportionate to the motor speed through the tubing 83 into the water as it exits the aspirator 46 to create a use solution. This use solution is then discharged through discharge tube 87. The dosing pump operates at a speed that is determined by the input voltage to the motor 75. Therefore the dilution rate is controlled by the motor voltage. The constant rate dosing pump is thereby activated by the control board 69 through the motor 75. It being understood that other constructions of the motor/pump combination may be utilized, such as the motor and pump being of one construction. The discharge tube 87 will typically empty into a bucket or container. When the container is full (typically visually monitored by the user), the user releases the activation button on the operator valve 27 and the diluent water flow ceases. When the water flow ceases, the aspirator 46 ceases to generate a vacuum and the previously generated vacuum is relieved through the bleed off device 65. The vacuum switch 63 then turns off thereby turning off the voltage flow to the motor 75. The pump 76 stops and the product is no longer dispensed. Any remaining water in the water line flows into the container as the vacuum breaker 31 allows air to enter the line between the vacuum breaker and the hose outlet. The user then removes the discharge hose 87 from the container and proceeds to the cleaning task. If a different concentration of use solution is required, the selector valve 58 is turned so that inlet port 58*c* is in fluid communication with the venturi port 46*c*. Vacuum is then transferred through tube 175, through passageway 62*e* to passageway 62*d* then through inlet 66*a* of vacuum switch 66. Then, the vacuum switch 66 is on the on position and turns on electrical power to the DC speed control board 70. The DC speed control board 70 then provides a voltage output to the motor which drives the dosing pump 76. The remainder of the operation being similar to what was described with respect to the vacuum switch 63.

It has been found that the use of a bleed valve device or precision orifice 65 and the use of the filter 64 is an important aspect of the present invention. The precision orifice 65 is always open to the atmosphere. Accordingly, air is always able to flow through the filter (to remove substantially all particulate matter) into passageway 62*c* and then into passageway 62*a* through the orifice 65*a*. It is the size of the orifice that controls the amount of air that is able to flow when there is a pressure difference. If the aspirator generated vacuum is not allowed to bleed off, turning the selector switch to a different setting can trap vacuum in the line thereby leaving the vacuum switch activated. The vacuum bleed device enables the vacuum to decrease even if the selector switch is turned. This allows the vacuum switches to turn off ensuring that the pump stops. It is understood that the vacuum bleed device must not allow too much air into the passageway 62*a* or 62*d* or the vacuum generated by the aspirator 46 will not be sufficient to activate the vacuum switch 63 or 66. At the same time, it must be sufficient to allow the vacuum to bleed off once the flow of diluent has ceased. This is a matter of sizing the orifice to allow these conditions to exist, which would be well known to one skilled in the art.

Figure 9:
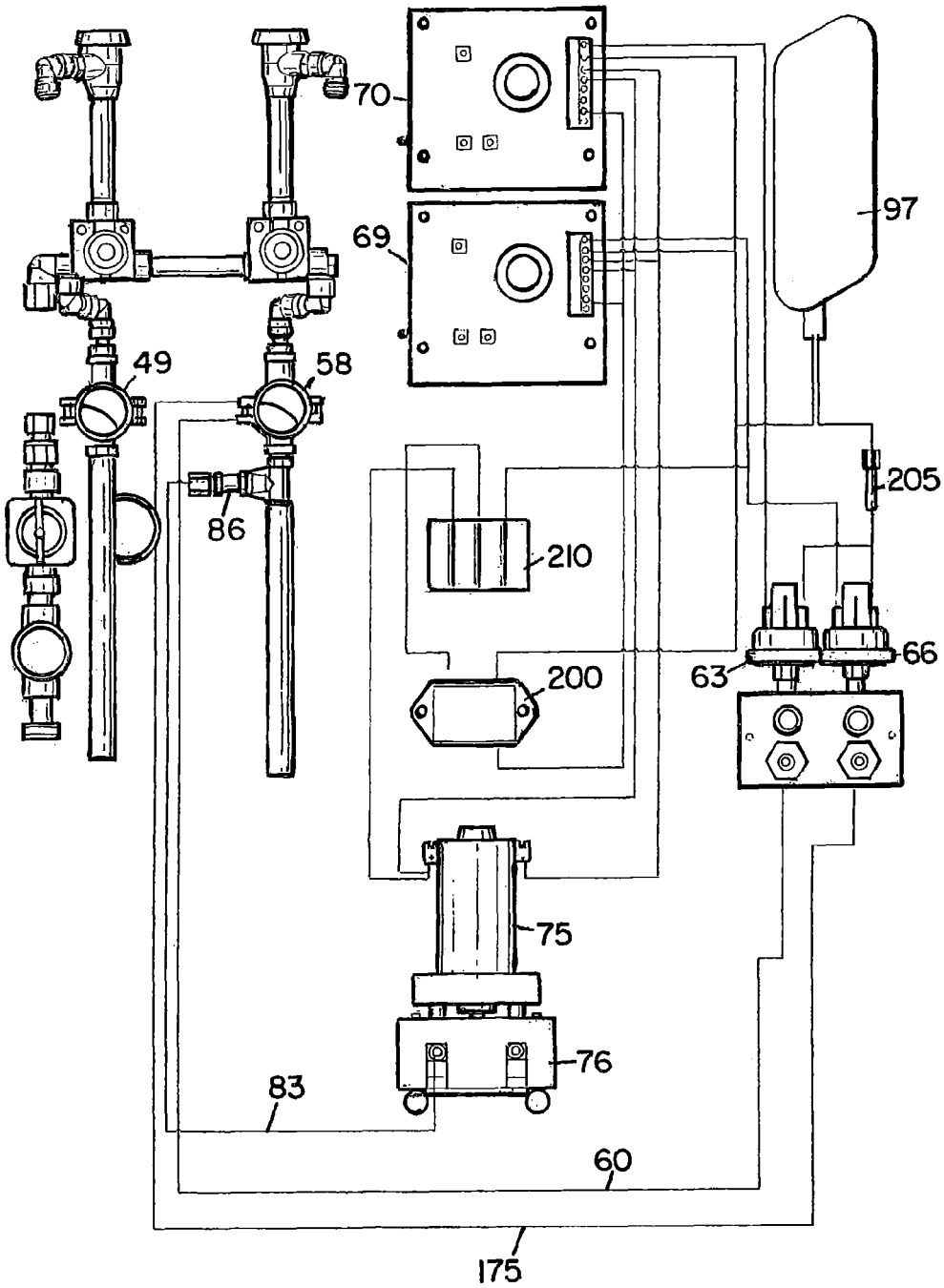
FIG. 9 is a schematic drawing for the dispenser shown in FIG. 1.

Referring now to FIG. 9, there is generally shown a schematic for the dispenser 10. The battery 97 provides electricity, through fuse 205, to vacuum switches 63, 66. The vacuum, generated by the second aspirator 46 is transferred via tubing 60 or 175, depending upon what selector valve inlet is chosen. Then, whatever switch 63, 66 is turned on by the vacuum, the appropriate control board 69, 70 in turn supplies power to the motor 75. The motor 75 in turn drives the pump 76 and product is supplied via tubing 83 to the manifold pipe 86 and a use solution is created. A volt meter 200 is connected to the battery and to the control board 69 and 70. Therefore, depending upon which way switch 210 is turned, the voltage is read either from the battery or the control boards. By selecting the switch 210 so that the voltage from the control board is read, it is easy to fine tune the voltage from the control boards 69, 70 by rotating their respective potentiometers. This provides an easy manner for the fine tuning of the concentration of the use solution.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispenser for dispensing a use solution, the dispenser comprising:

(a) a diluent inlet for receiving a source of diluent;

(b) an aspirator in fluid communication with the diluent inlet;

(c) an operator valve, for control of the diluent's flow, moveable between an off position and an on position;

(d) the aspirator having a diluent inlet, a diluent outlet and a venturi port;

(e) a vacuum switch operatively connected to the venturi port, wherein flow of diluent through the aspirator creates a vacuum and activates the vacuum switch;

(f) a control device activated by the vacuum switch;

(g) a manifold block having a first manifold inlet operatively connected to the venturi port and a manifold outlet operatively connected to the vacuum switch;

(h) a second manifold inlet operatively connected to the manifold outlet;

(i) a vacuum bleed device positioned in the second manifold inlet;

(j) the second manifold inlet is open to atmosphere;

(k) a dosing pump having an inlet for receiving a source of liquid product and an outlet in fluid communication with the diluent, wherein a use solution is made; and (l) the dosing pump activated by the control device.

2. The dispenser of claim 1, wherein the diluent is water.

3. The dispenser of claim 1, wherein the control device is an analog voltage control board.

4. The dispenser of claim 1, further comprising:

(a) the manifold block has a first passageway from the first manifold inlet to the manifold outlet;

(b) a second passageway from the second manifold inlet to the first passageway; and (c) a precision orifice positioned in the second passageway, wherein flow of air from the atmosphere to the vacuum switch is controlled.

5. The dispenser of claim 4, further comprising a filter operatively connected to the precision orifice, wherein particulate matter is substantially prevented from blocking the precision orifice.

6. The dispenser of claim 1, further comprising a vacuum breaker having a vacuum breaker inlet in fluid communication with the diluent inlet and a vacuum breaker outlet in fluid communication with the aspirator.

7. The dispenser of claim 1, further comprising:

(a) a discharge tube having a first end in fluid communication with the aspirator's diluent outlet and a second end for dispensing the use solution; and (b) the discharge tube having a product inlet, the product inlet is in fluid communication with the dosing pump's outlet.

8. The dispenser of claim 1, further comprising:

(a) a discharge tube having a first end in fluid communication with the aspirator's diluent outlet and a second end for dispensing the use solution;

(b) a mixing manifold operatively connected to the discharge tube; and (c) the manifold having a product inlet in fluid communication with the dosing pump's outlet.

9. The dispenser of claim 1, wherein the dosing pump is a constant rate peristaltic pump.

10. A dispenser for dispensing a use solution, the dispenser comprising:

(a) a water inlet for receiving a source of water;

(b) an aspirator in fluid communication with the water inlet;

(c) an operator valve, for control of the water's flow, moveable between an off position and an on position;

(d) the aspirator having a water inlet, a water outlet and a venturi port;

(e) a vacuum switch operatively connected to the venturi port, wherein flow of water through the aspirator creates a vacuum and activates the vacuum switch;

(f) control device activated by the vacuum switch;

(g) a manifold block having a first manifold inlet operatively connected to the venturi port and a manifold outlet operatively connected to the vacuum switch;

(h) a second manifold inlet operatively connected to the manifold outlet;

(i) a vacuum bleed device positioned in the second manifold inlet;

(j) the second manifold inlet is open to atmosphere;

(k) a constant rate dosing pump having an inlet for receiving a source of liquid product and an outlet in fluid communication with the water, wherein a use solution is made; and (l) the constant rate dosing pump activated by the control device.

11. The dispenser of claim 10, further comprising:

(a) the manifold block has a first passageway from the first manifold inlet to the manifold outlet;

(b) a second passageway from the second manifold inlet to the first passageway; and (c) a precision orifice positioned in the second passageway, wherein flow of air from the atmosphere to the vacuum switch is controlled.

12. The dispenser of claim 11, further comprising a filter operatively connected to the precision orifice, wherein particulate matter is substantially prevented from blocking the precision orifice.

13. A dispenser for dispensing multiple use solutions, the dispenser comprising:

(a) a diluent inlet for receiving a source of diluent;

(b) an aspirator in fluid communication with the diluent inlet;

(c) an operator valve, for control of the diluent's flow, moveable between an off position and an on position;

(d) the aspirator having a diluent inlet, a diluent outlet and a venturi port;

(e) a selector valve having an inlet operatively connected to the venturi port and a first outlet and a second outlet, the selector valve connecting either the first selector valve outlet or the second selector valve outlet to the selector valve inlet;

(f) a first vacuum switch operatively connected to the first selector valve outlet and a second vacuum switch operatively connected to the second selector valve outlet, wherein flow of diluent through the aspirator creates a vacuum to selectively activate the first and second vacuum switches;

(g) a control device activated by the first vacuum switch and the control device activated by the second vacuum switch;

(h) a dosing pump selectively activated by the control device.

14. The dispenser of claim 13, wherein the diluent is water.

15. The dispenser of claim 14, wherein the control device is analog voltage control boards.

16. The dispenser of claim 15, further comprising:

(a) a first bleed valve device having a vented passageway, the vented passageway having a first end open to atmosphere and a second end operatively connected to the first vacuum switch; and (b) a second bleed valve device having a vented passageway, the vented passageway having a first end open to atmosphere and a second end operatively connected to the second vacuum switch.

17. The dispenser of claim 16, wherein the bleed device has a precision orifice.

18. The dispenser of claim 13, where the control device comprises a first control device and a second control device.

19. A dispenser for dispensing a use solution, the dispenser comprising:

(a) a diluent inlet for receiving a source of diluent;

(b) an aspirator in fluid communication with the diluent inlet;

(c) an operator valve, for control of the diluent's flow, moveable between an off position and an on position;

(d) the aspirator having a diluent inlet, a diluent outlet and a venturi port;

(e) a vacuum switch operatively connected to the venturi port, wherein flow of diluent through the aspirator creates a vacuum and activates the vacuum switch;

(f) a control device activated by the vacuum switch;

(g) a bleed valve device having a vented passageway, the vented passageway having a first end open to atmosphere and a second end operatively connected to the vacuum switch;

(h) a dosing pump having an inlet for receiving a source of liquid product and an outlet in fluid communication with the diluent, wherein a use solution is made; and (i) the dosing pump activated by the control device.

* * * * *